US006088930A

United States Patent [19]

Robin et al.

[11] Patent Number: 6,088,930

[45] Date of Patent: Jul. 18, 2000

[54] CONVECTION-RADIATION SYSTEM FOR HEAT TREATMENT OF A CONTINUOUS STRIP

[75] Inventors: Jean-Pierre Robin, Bondues; Yannick Lescanne, Lille, both of France

[73] Assignee: Solaronics Process SA, France

[21] Appl. No.: 09/189,897

[22] Filed: Nov. 11, 1998

[30] Foreign Application Priority Data

Nov. 14, 1997 [FR] France ..... 97 14321

[51] Int. Cl.[7] ..... F26B 3/34

[52] U.S. Cl. ..... 34/267; 34/274; 34/621; 34/632; 34/635; 34/643

[58] Field of Search ..... 34/266, 267, 273, 34/274, 611, 618, 621, 623, 629, 632, 635, 638, 639, 643; 226/95, 96, 97

[56] References Cited

U.S. PATENT DOCUMENTS

| | | | |
|---|---|---|---|
| 4,320,587 | 3/1982 | Vits | 34/643 |
| 4,936,025 | 6/1990 | Heikkila | 34/420 |
| 5,261,166 | 11/1993 | Seeley et al. | 34/267 |
| 5,537,925 | 7/1996 | Secor et al. | 34/274 X |
| 5,588,223 | 12/1996 | Marshall | 34/635 X |
| 5,606,805 | 3/1997 | Meyer . | |
| 5,752,641 | 5/1998 | Klas et al. | 34/643 X |
| 5,867,920 | 2/1999 | Rogne et al. | 34/267 |
| 5,966,836 | 10/1999 | Valdez, III et al. | 34/267 X |

FOREIGN PATENT DOCUMENTS

| | | |
|---|---|---|
| 0235723 | 9/1987 | European Pat. Off. . |
| 0291832 | 11/1988 | European Pat. Off. . |
| 0346081 | 12/1989 | European Pat. Off. . |
| 0508254 | 10/1992 | European Pat. Off. . |
| 0539013 | 4/1993 | European Pat. Off. . |
| 2247687 | 5/1975 | France . |
| 2306733 | 11/1976 | France . |
| 1340311 | 1/1987 | France . |
| 1951345 | 4/1971 | Germany . |
| 296 02 178 U | 4/1996 | Germany . |
| 8808950 | 11/1988 | WIPO . |

*Primary Examiner*—Stephen Gravini
*Attorney, Agent, or Firm*—Bachman & LaPointe, P.C.

[57] ABSTRACT

In a heat treatment installation a strip moves continuously past infrared radiant elements and elements for blowing air onto the strip. The installation comprises a succession of blower elements separated from each other by at least one infrared radiant element, each blower element having on each side of it a suction element near an infrared radiant element.

16 Claims, 4 Drawing Sheets

CONVECTION-RADIATION SYSTEM FOR HEAT TREATMENT OF A CONTINUOUS STRIP

BACKGROUND OF THE INVENTION

1. Field of the Invention

The invention concerns a convection-radiation system for heat treatment of a continuous strip.

2. Description of the Prior Art

Continuous strips or deposits on continuous strips require heat treatment. The heat treatment must often be carried out without contact in order to preserve the quality of the surface state of the strip or the deposit on it. This applies, for example, to paper strips that have undergone a wet treatment such as the treatment to produce art paper.

There are currently two different techniques for heat treating continuous strips without contact:

- either continuous strip heating using infrared radiant elements,
- or heating by means of hot air blower elements.

Infrared radiant elements have a very high power density (power per unit surface area) which means that heat treatment can be carried out using a relatively compact installation.

However, the use of such radiant elements requires the use of means for supporting the continuous strip, which support means must not under any circumstances enter into contact with the paper strip.

Hot air heating systems have the drawback of a much lower power density than systems using infrared radiant elements and so they are much larger overall than a system using infrared radiant elements to carry out the same heat treatment.

On the other hand, this type of installation does not require any auxiliary means to support the strip; this function being assured by the air, which can also produce corrugations in the strip to increase its stiffness in the direction perpendicular to its motion.

One example of an installation of the above type is described in international application WO 95/14199.

Attempts have been made to combine the two techniques described hereinabove in order to associate their respective advantages.

One such attempt is described in European patent 0 291 832 or U.S. Pat. No. 5,261,166. However, the solution described in the above patent is not perfect for at least the following reasons:

- the blower devices are not perfectly protected from the radiation from the infrared emitters, and
- the blown air can disturb correct operation of the infrared radiation emitter.

The aim of the present invention is to remedy the drawbacks of the above techniques by creating an installation for drying a continuous strip that is of small overall size, delivers a high heating power density and provides a solution to the problem of supporting the continuous strip.

SUMMARY OF THE INVENTION

Accordingly, the invention consists in a system for convection-radiant heat treatment of a strip moving past infrared radiant elements and elements for blowing air onto the strip comprising a succession of blower elements separated from each other by at least one infrared radiant element wherein each blower element has on each side of it a suction element near an infrared radiant element.

Thus the installation of the invention combines infrared radiant elements with blower elements and suction elements.

The overall size of the installation is much smaller because:

- the infrared radiant elements deliver a high power density, and
- the volumes of air blown are at least 30% smaller than those circulating in an installation using only hot air.

The blower elements support the strip without contact without using any auxiliary means and produce corrugations in the strip making it mechanically rigid in the direction perpendicular to its motion.

The suction elements disposed between the rows of infrared radiant elements on respective opposite sides of a blower element:

- aspirate to the exterior air charged with water vapor from the strip when it is to be dried, air blown by the blower elements and combustion gases from the infrared radiant elements when the latter are of the gas-fired type, and
- effectively protect the blower elements from the radiation from the infrared radiant elements, the blower systems requiring dimensional stability to operate correctly.

The configuration of the blower-suction modules is such that they do not disturb the operation of the infrared radiant elements.

In a preferred version of the invention the blower elements are separated from each other by two parallel rows of infrared radiant elements.

Each blower element preferably has near the strip at least one air blower slot transverse to the direction of motion of the strip.

Other features and advantages of the invention will become more apparent in the following description with reference to the accompanying drawings, which are given by way of non-limiting example.

DETAILED DESCRIPTION OF THE PREFERRED EMBODIMENTS

Figure 1:
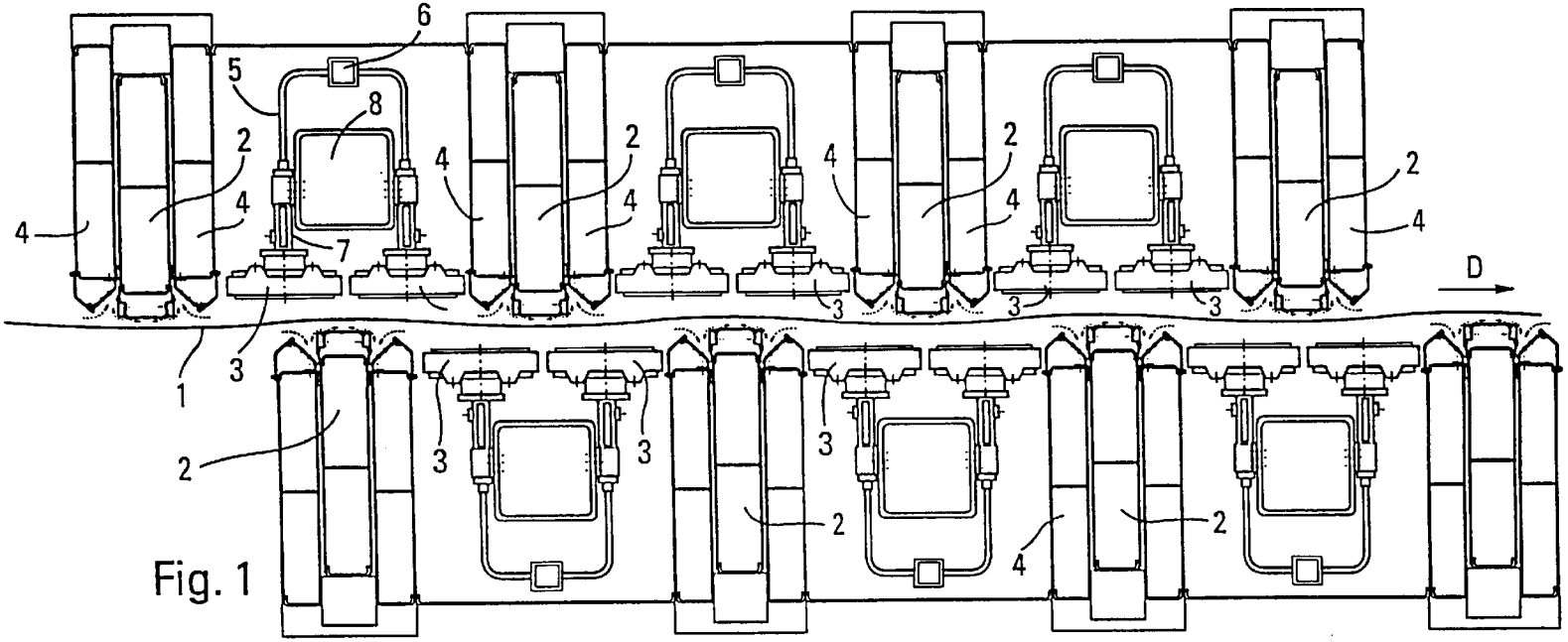
FIG. 1 is a diagrammatic view in partial longitudinal section of a heat treatment installation in accordance with the invention.

The preferred version of the invention shown in FIG. 1 concerns an installation for heat treating a strip 1 that can move at speeds up to 2000 m/min or more.

The heat treatment installation in accordance with the invention comprises a succession of blower elements 2 separated from each other by at least one infrared radiant element 3. Each blower element 2 has a suction element 4 on each side and near an infrared radiant element 3.

The radiant surface of the radiant elements 3 is parallel to the strip 1.

The blower elements 2 and the suction elements 4 are substantially parallelepiped-shape box sections extending vertically and in the widthwise direction of the strip.

The blower elements 2 are connected to means (not shown) for increasing the air pressure.

The suction elements 4 are connected to means (not shown) for reducing the air pressure.

In the example shown the blower elements 2 are separated from each other by two parallel rows of infrared radiant elements 3.

Each blower element 2 has near the strip at least one and preferably two air blower slots 8 (see FIG. 2) transverse to the direction D of motion of the strip 1.

Figure 2:
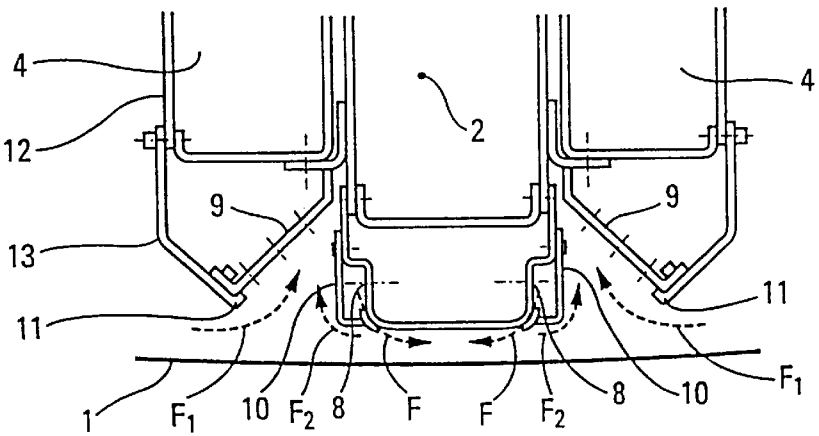
FIG. 2 is a view to a larger scale of the bottom part of a blower element and two adjacent suction elements.

As shown in more detail in FIG. 2, each suction element has near the strip 1 a suction nozzle 9 forming an acute dihedron with the adjacent end wall 10 of the blower element 2. The distance between the base of the dihedron and the strip 1 is in the range 5 mm to 50 mm and in the preferred version of the invention this distance is in the range 10 mm to 25 mm.

The edge 11 of the suction nozzle 9 nearest the strip 1 is joined to the lateral wall 12 of the suction element 4 by a broken wall 13.

The disposition of the suction nozzle 9 simultaneously:

achieves effective suction: air charged with water vapor in the case of a drying operation, air blown by the modules 2, combustion gases if the infrared elements are of the gas-fired type or air for cooling the electrical connections if the radiant elements are electrical infrared emitters, prevents disturbance to the operation of the infrared radiant elements 3, protects the blower modules 2 from the radiation emitted by the radiant elements 3, and maintains the efficiency of the blower modules by preventing disturbance to the compressed air cushion created by them on the strip 1.

Figure 3:
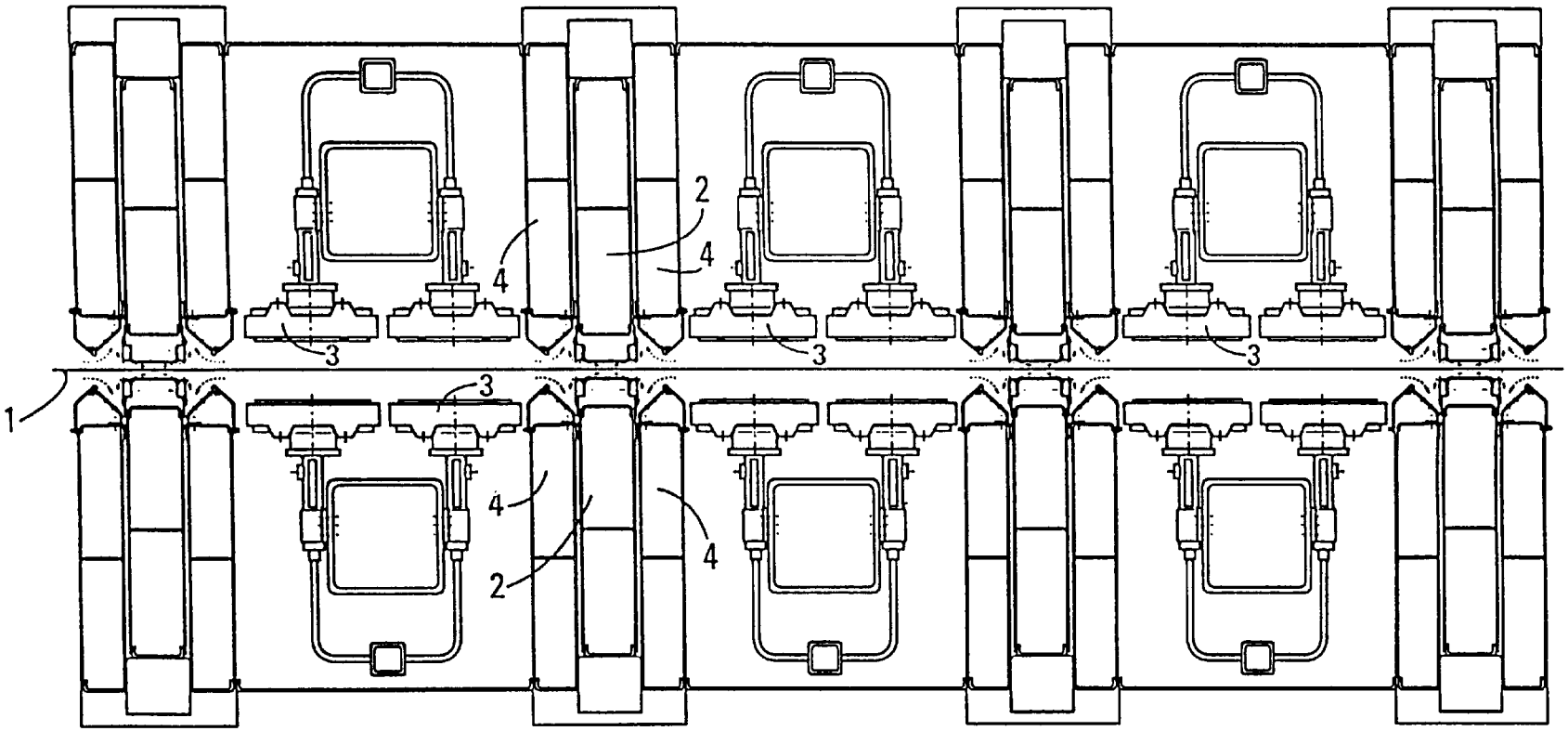
FIG. 3 is a view analogous to FIG. 1 relating to a variant of the heat treatment installation.

In the example of FIGS. 1 and 3 infrared radiant elements 3, blowing elements 2 and suction elements 4 are situated on each side of the strip 1.

In the installation shown in FIG. 3 the elements 3, 2 and 4 are disposed symmetrically on respective opposite sides of the strip 1.

In the preferred version shown in FIG. 1 the elements 3, 2 and 4 on one side of the strip 1 are offset in the direction D of motion of the strip 1 relative to the elements 3, 2, 4 on the other side of the strip 1. The offset is such that the infrared radiant elements 3 on one side face the blower elements 2 and the suction elements 4 on the other side.

This staggered arrangement produces corrugations in the strip 1 that mechanically stiffen it in the direction perpendicular to its motion.

Figure 4:
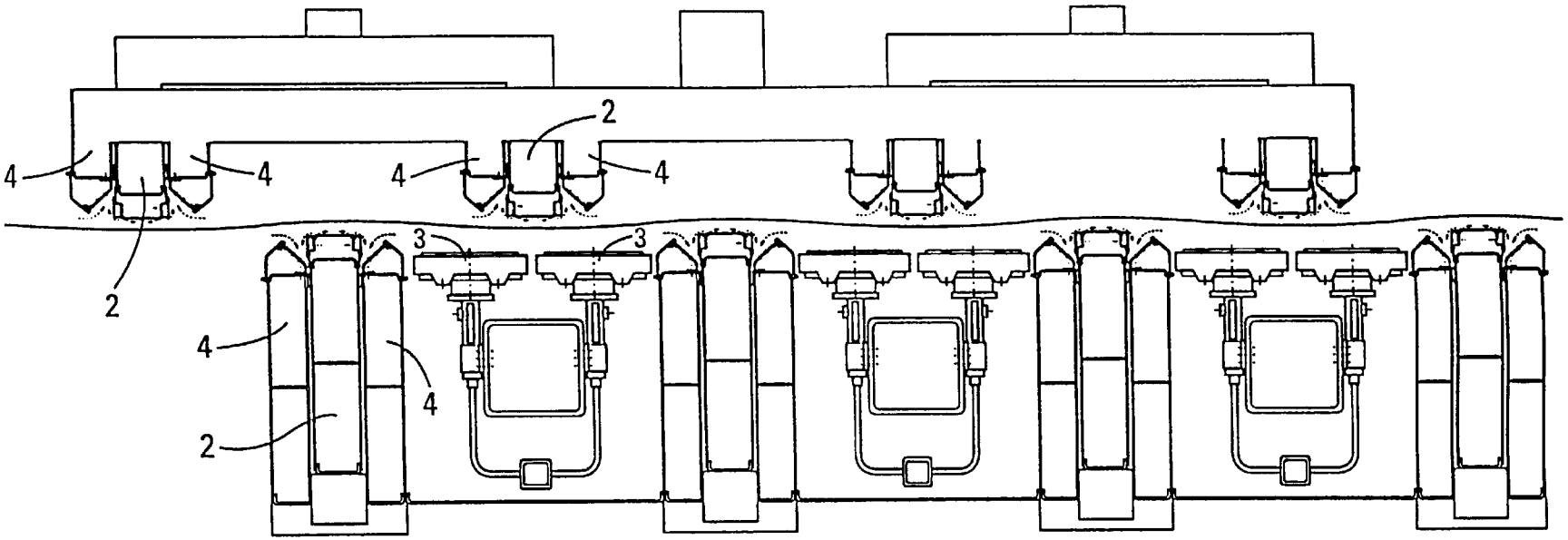
FIGS. 4 and 5 are views analogous to FIGS. 1 and 3 concerning two other variants.
Figure 5:
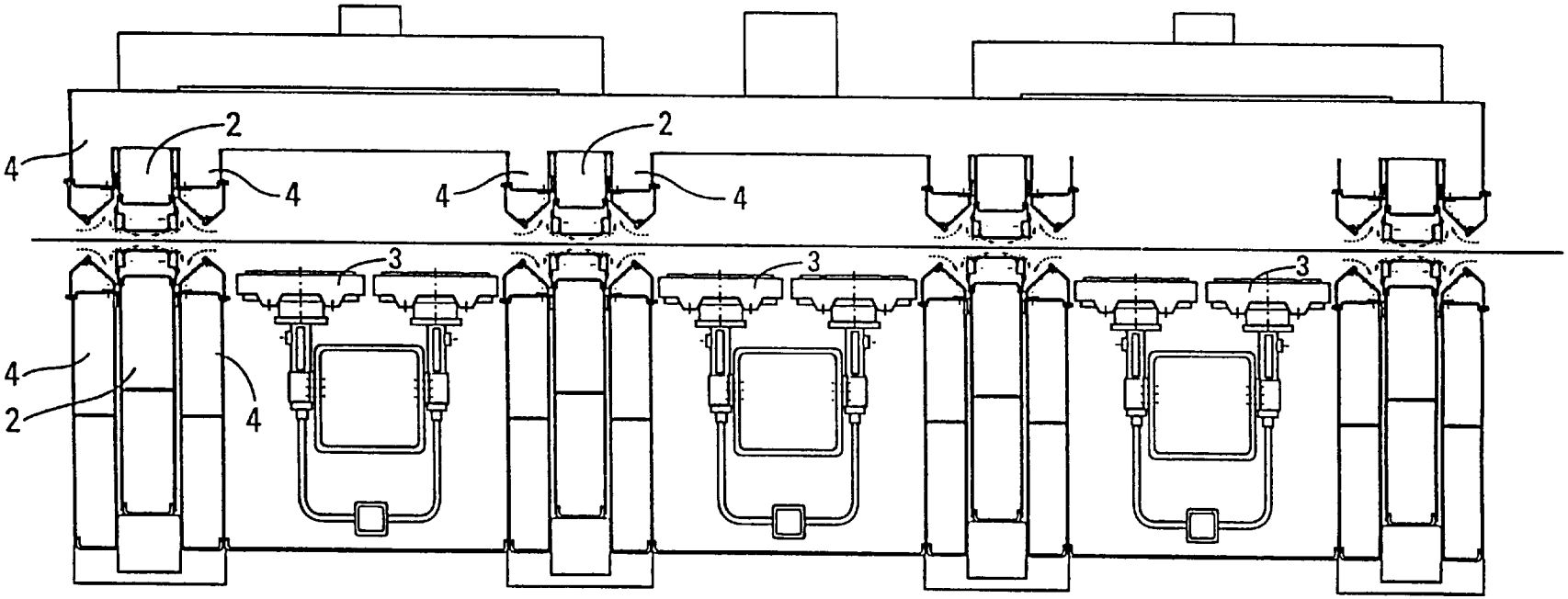

In the FIG. 4 example a succession of radiant elements 3, blower elements 2 and suction elements 4 are disposed on one side of the strip 1 while on the other side there are only blower elements 2 and suction elements 4. In this configuration the suction elements 4 can be dispensed with.

The distribution of the infrared radiant elements 3 and/or the blower elements 2 and suction elements 4 can vary along the direction D in which the strip 1 moves.

This distribution allows for the fact that the power density may need to vary along the path of the strip.

The heat treatment installation just described operates in the following manner:

The strip 1 to be treated moves continuously in the direction D between the two superposed series of elements 3, 4, 2.

The air blown by the blower elements 2 (arrows F in FIG. 2) holds the strip 1 at a distance from the successive elements 3, 4, 2 and so supports the strip during its passage through the installation without any auxiliary supporting devices.

The infrared radiant elements 3 which have a high power density transfer energy to the strip 1.

The suction elements 4 on either side of each blower element 2 suck in through their suction nozzle 9 combustion gases emitted by the radiant elements 3 if they are of the gas-fired type, water vapor emitted by the strip 1 if it is being dried (arrows $F_1$ in FIG. 2) and air from the blower elements 2 (arrows $F_2$).

In another embodiment, if the radiant elements are provided on one side only, reflectors can be disposed on the side opposite the radiant elements 3 to improve the thermal efficiency of the system.

In this case the reflectors are disposed alternately with blower elements to ensure that the paper is supported.

Also, the reflectors can additionally serve as suction members.

Finally, in another arrangement, reflectors can be disposed between the blower and suction elements.

In all cases the disposition of the radiant, blower and suction elements can enable the strip to follow a rectilinear path.

The principal advantages of the installation that has just been described are as follows:

the installation has a high power per unit surface area, thanks to the radiant elements 3, blower elements 2 and suction elements 4 which, because of their compact shape and small overall size, do not greatly affect the overall size of the installation as a whole.

the blower elements 2 support the strip 1 without rollers or other auxiliary means over the whole or part of the path of the strip through the installation.

the disposition of suction elements 4 on opposite sides of a blower element 2 provides efficient suction of water vapor emitted by the strip if the latter is in an evaporation phase and combustion gases emitted by the radiant elements 3 if they are of the gas-fired type, together with air blown by the elements 2, which therefore do not disturb the operation of the infrared elements.

Of course, the invention is not limited to the embodiments that have just been described to which many modifications can be made without departing from the scope of the invention.

There is claimed:

1. A system for convection-radiant heat treatment of a strip moving past infrared radiant elements and elements for blowing air onto the strip, said system comprising a plurality of blower elements separated from each other by at least one infrared radiant element wherein each of said blower elements has two sides, a first suction element positioned adjacent a first one of said sides, a second suction element positioned adjacent a second one of said sides, and at least one of said first and second suction elements is positioned near an infrared radiant element located between a respective blower element and an adjacent blower element.

2. The installation claimed in claim 1 wherein each of said blower elements has near said strip at least one air blower slot transverse to the direction of motion of said strip.

3. The installation claimed in claim 1 wherein each said suction element has near said strip a suction nozzle forming an acute dihedron with an adjacent end wall of said blower element.

4. The installation claimed in claim 3 wherein an edge of said suction nozzle nearest said strip is joined to a lateral wall of said suction element by a broken wall.

5. The installation claimed in claim 1 wherein said infrared radiant elements, blower elements and suction elements are situated on each side of said strip.

6. The installation claimed in claim 5 wherein said radiant elements, said blower elements, and said suction elements are disposed symmetrically on respective opposite sides of said strip.

7. The installation claimed in claim 5 wherein the radiant elements, said blower elements, and said suction elements on one side of said strip are offset in the direction of movement of said strip relative to the radiant elements, said blower elements, and said suction elements on the other side of said strip so that infrared radiant elements on said one side face blower elements and suction elements on the other side.

8. The installation claimed in claim 1 wherein a succession of radiant elements, blower elements and suction elements are disposed on one side of said strip and only blower elements are disposed on the other side of said strip.

9. An installation as claimed in claim 8 wherein reflectors are disposed between said blower elements on the other side of said strip opposite said radiant elements.

10. The installation claimed in claim 9 wherein said reflectors serve as suction elements.

11. The installation claimed in claim 1 wherein a succession of radiant elements, blower elements and suction elements are disposed on one side of said strip and only blower elements and suction elements are disposed on the other side of said strip.

12. An installation as claimed in claim 11 wherein reflectors are disposed between said blower and suction elements disposed on the other side opposite said radiant elements.

13. The installation claimed in claim 1 wherein the distribution of infrared radiant elements and/or blower elements and suction elements varies along the direction of motion of said strip.

14. The installation claimed in claim 1 wherein said infrared radiant elements are gas-fired radiant burners.

15. The installation claimed in claim 1 wherein said infrared radiant elements are electrical radiant emitters.

16. The installation claimed in claim 1 wherein the disposition of said radiant, blower and suction elements enables said strip to follow a non-rectilinear path.

* * * * *